United States Patent [19]

Cross et al.

[11] Patent Number: 4,711,509

[45] Date of Patent: Dec. 8, 1987

[54] ELECTRICAL CONNECTOR

[75] Inventors: William E. Cross, Brookfield; Jeanne E. Hillestad, Niles; Robert G. Plyler, Vienna, all of

[73] Assignee: General Motors Corporation, Detroit, Mich.

[21] Appl. No.: 804,934

[22] Filed: Dec. 5, 1985

[51] Int. Cl.[4] ..... H01R 11/00

[52] U.S. Cl. ..... 439/587; 439/271; 439/595

[58] Field of Search ..... 339/59 R, 59 M, 60 R, 339/60 M, 94 R, 94 M, 242

[56] References Cited

U.S. PATENT DOCUMENTS

| | | | |
|---|---|---|---|
| 3,845,452 | 10/1974 | Eifler | 339/59 R |
| 4,150,866 | 4/1979 | Snyder, Jr. et al. | 339/94 M |
| 4,295,698 | 10/1981 | Chow | 339/59 R |
| 4,311,355 | 1/1982 | Plyler et al. | 339/94 R |
| 4,319,799 | 3/1982 | Pearce, Jr. | 339/217 R |
| 4,386,816 | 6/1983 | Frear et al. | 339/59 R |
| 4,531,796 | 7/1985 | Gansert et al. | 339/94 M |
| 4,580,863 | 4/1986 | Lohr et al. | 339/94 M |

*Primary Examiner*—Gil Weidenfeld
*Assistant Examiner*—Paula A. Austin
*Attorney, Agent, or Firm*—F. J. Fodale

[57] ABSTRACT

An electrical connector comprises a connector body having two rows of terminal cavities which extend axially through the connector body. The connector body has a nose portion which comprises a plurality of ribs which define channels at the forward portions of the terminal cavities. An elastomeric seal ring is mounted on the connector body and extends across the channels to bias the terminals against the bottoms of the channels and into interference positions with respect to lock shoulders which retain the terminals in the rearward direction. A cap member mounted on the nose portion of the connector body retains the terminals in the forward direction, holds the terminals in their interference positions in the terminal cavities and fastens the elastomeric seal ring in the axial direction.

10 Claims, 6 Drawing Figures

ELECTRICAL CONNECTOR

This invention relates generally to electrical connectors and more particularly to electrical connectors having terminal retention features.

It is already known from U.S. Pat. No. 4,295,698 granted Oct. 20, 1981 to Weichien Chow to provide an electrical connector having a connector body or housing with terminal retention features which include integral flexible latches. These flexible latches engage the terminals which are inserted into the terminal cavities and bias the terminals downwardly against the cavity bottom walls so that the contacts of the terminals are disposed ahead of lock shoulders in the terminal cavities. The terminals are thus positioned in an interference relationship with the lock shoulders by the flexible latches for retention in the rearward direction. The lock shoulders by which the terminals are retained in the rearward direction are solid integral parts of the connector body or housing. However, the positioning and maintenance of the terminals in the interference position is dependent solely on the flexible latches which are not as strong or reliable as the solid lock shoulders.

The object of our invention is to provide an electrical connector having an improved terminal retention feature particularly in regards to positioning the terminal or terminals in an interference relationship with solid lock shoulders in the terminal cavities of the connector body or housing.

A feature of the invention is that the terminal or terminals are held in the interference position by a solid rather than flexible plastic part so that the retention of the terminal or terminals is very strong and reliable in all directions.

Another feature of the invention is that the inserted terminal or terminals are moved to the interference position with respect to the solid lock shoulders of the connector body by an elastomeric ring which is easily molded and considerably less complicated than separate flexible latches in each cavity, particularly in multiple terminal connectors.

Yet another feature of the invention is that the use of an elastomeric ring to position the terminal or terminals in an interference relationship with the lock shoulders in the respective terminal cavities facilitates connector sealing as the elastomeric ring is easily adapted to provide a securely fastened seal ring.

Other objects and features of the invention will become apparent to those skilled in the art as the disclosure is made in the following detailed description of a preferred embodiment of the invention as illustrated in the accompanying sheets of drawing in which.

Figure 1:
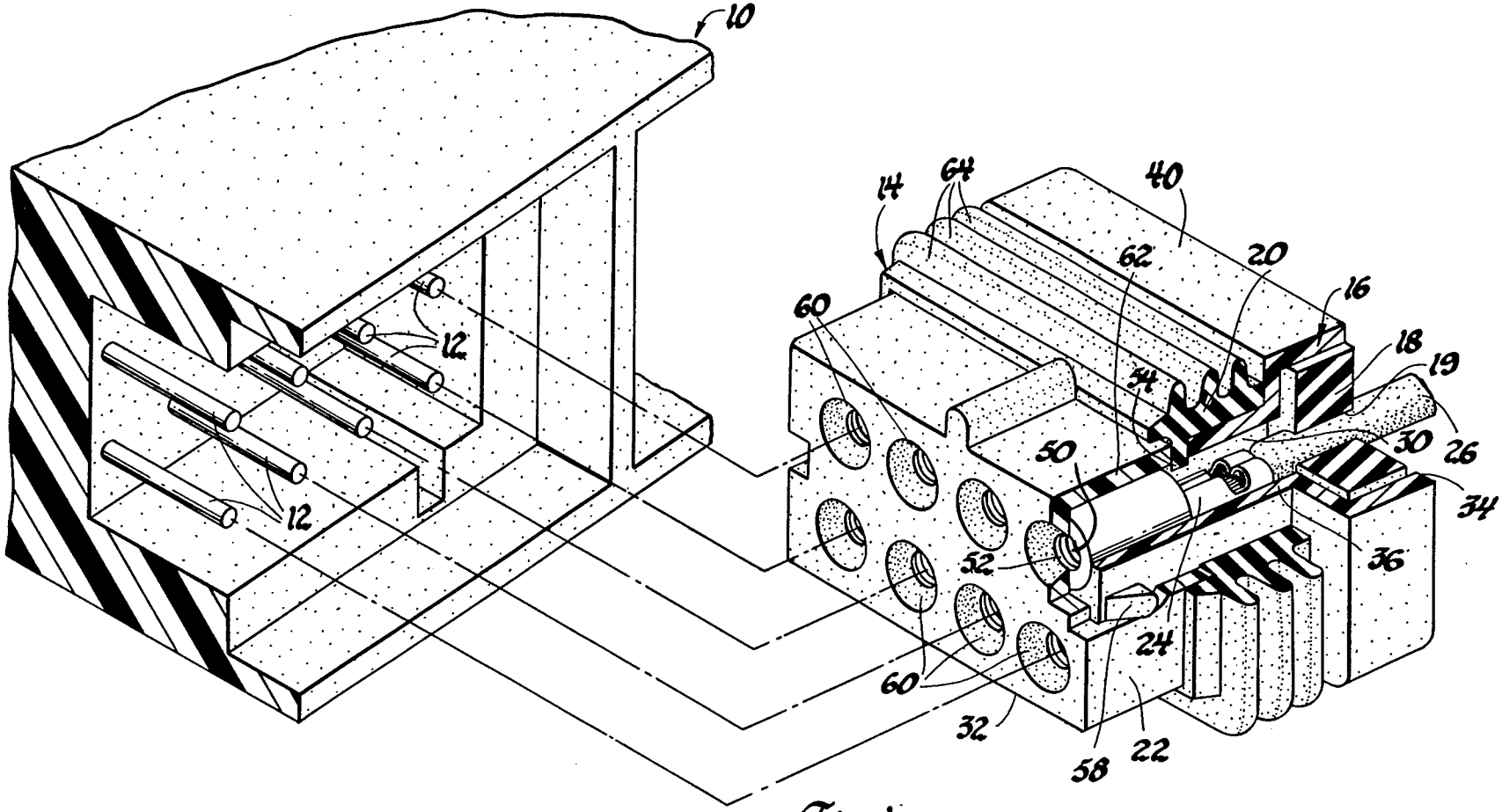
FIG. 1 is an exploded, partially sectioned, perspective view of a sealed electrical connection which includes an electrical connector in accordance with our invention.

Referring now to the drawing, and more particularly to FIG. 1, there is shown a sealed electrical connection comprising an electrical socket connector 10 having a plurality of male pin terminals 12 and a mating plug-in electrical connector 14.

The electrical connector 14 comprises a thermoplastic connector body 16, a conductor seal pad 18 of synthetic rubber or the like, an elastomeric seal ring 20, a thermoplastic cap member 22 and a plurality of terminals 24 attached to insulated conductors 26.

The connector body 16 has a plurality of terminal cavities 30 which extend axially through the connector body from a forward contact end 32 to a rearward conductor end 34. The connector body 16 has a medial portion 36 which lies between a nose portion 38 of reduced height at the contact end 32 and an enlarged shroud 40 at the conductor end 34. The shroud 40 provides a common chamber for the terminal cavities 30 at the conductor end 34. This chamber receives the conductor seal pad 18 which has a sealing aperture 19 for each terminal cavity 30 which is sized to seal around the conductor 26 when the terminals 24 are fully inserted into the connector body 16.

Figure 2:
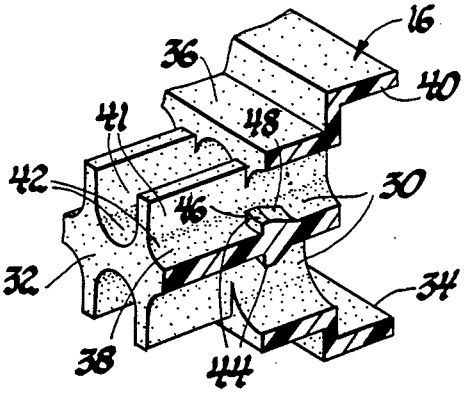
FIG. 2 is a sectioned perspective view of the connector body of the electrical connector shown in FIG. 1.

The terminal cavities 30 are of oval cross section and elongated in the vertical direction corresponding to the height of the nose portion 38. The nose portion 38 comprises a plurality of ribs defining a channel 42 at the forward portion of each terminal cavity. Each terminal cavity 30 has a wedge shaped protrusion 44 in the wall portion corresponding to the bottom of the channel. Each protrusion 44 includes a lock shoulder 46 which faces the forward contact end 32 of the connector body and a ramp 48 which faces the rearward conductor end 34. The lock shoulder 46 is located at the juncture of the medial portion 36 and the nose portion 38 as best seen in FIG. 2.

One of the terminals 24 is disposed in each terminal cavity 30 as indicated in FIGS. 1, 4, 5 and 6. Each terminal 24 has a female tubular contact 50 of circular outline at one end which is disposed in the channel 42 of the terminal cavity 30. Each terminal 24 is attached to an insulated conductor 26 in a conventional manner by two sets of crimp wings at the other end. The tubular contact 50 preferably includes a separate eyelet 52 fitted over and secured to the contact at the one end of the terminal.

Figure 3:
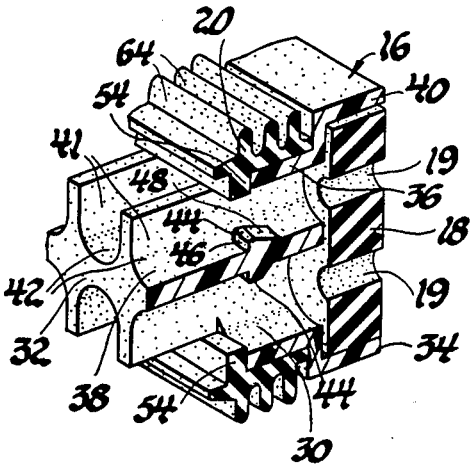
FIG. 3 is a sectioned perspective view of a subassembly of the electrical connector shown in FIG. 1.

The elastomeric ring 20 is generally rectangular in shape and it is mounted on the medial portion 36 of the connector body 16 before the terminals 24 are inserted into the terminal cavities 30 as shown in FIG. 3. The elastomeric ring 20 is preferably slightly undersized so that it is circumferentially stretched when it is mounted on the medial portion 36.

Figure 4:
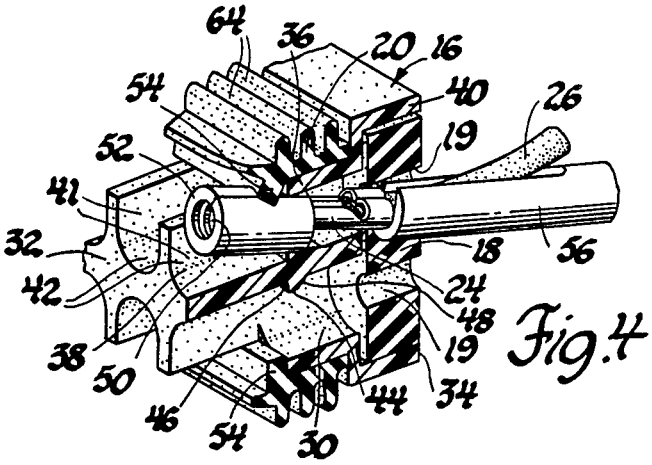
FIGS. 4 and 5 are sectioned perspective views showing insertion of a terminal into the subassembly shown in FIG. 3.
Figure 5:
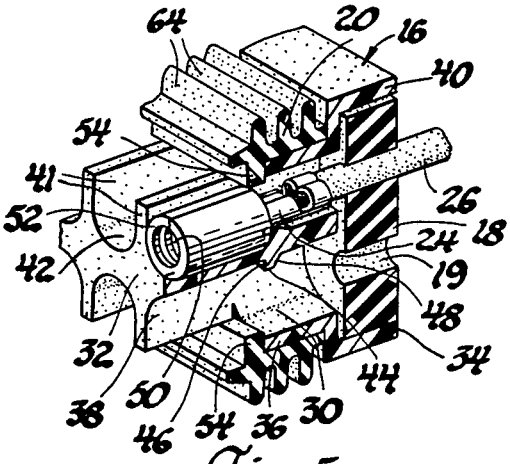
Figure 6:
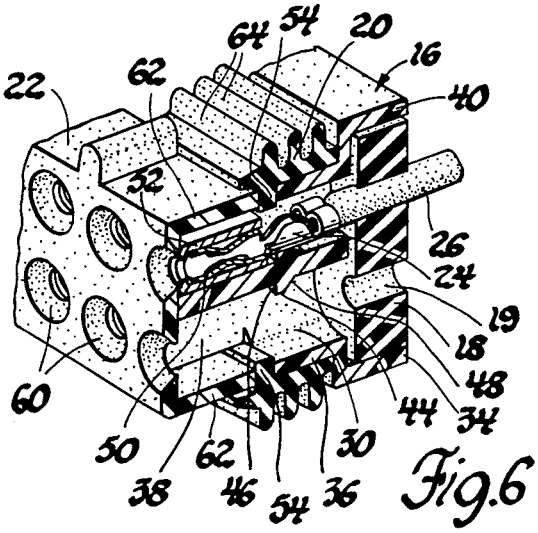
FIG. 6 is a sectioned perspective view of the assembled electrical connector shown in FIG. 1.

The elastomeric ring 20 has a pair of depending flexible lips 54 directed radially inward. The lips 54 engage the ribs 41 of the nose portion 38 and extend across the channels 42 at the forward portions of the terminal cavities 30 so that the flexible lips 54 are located diametrically opposite and just ahead of the wedge shaped protrusions 44. The terminals 24 are inserted into the terminal cavities 30 through the sealing apertures 19 of the conductor seal pad 18 by means of a tool 56 as shown in FIG. 4. As the terminals 24 are inserted, the flexible lips 54 engage and bias the tubular contacts 50 downwardly into the channels 42 until the terminals 24 are fully inserted and the tubular contacts 50 are in an interference position ahead of the wedge shaped protrusions 44 as shown in FIG. 5. Thus positioned, the tubular contact 50 of each terminal 30 then cooperates with one of the lock shoulders 46 to retain the terminal 30 in its terminal cavity 30 in the rearward direction.

The height of the ribs 41 is preferably such that the height from the bottom of each channel 42 to the associated flexible lip 54 is less than the diameter of the tubular contact 50. In this manner, the flexible lips 54 bias the tubular contacts 50 against the bottoms of the channels 42 thus assuring that the terminals 24 are properly located in interference positions in the terminal cavities 30. The flexible lips 54 are sufficiently flexible to permit the tubular contacts 50 to ride over the cooperating wedge shaped protrusions 44 and reach the interference positions as shown in FIGS. 4 and 5, respectively.

After all of the terminals 24 are inserted into the connector body 16, the cap member 22 is mounted on the nose portion 32 of the connector body 16 and retained thereon by lock nibs 58 as shown in FIG. 1. The cap member 22 has inlets 60 extending through its face plate which open into the terminal cavities 30 and lead into the respective tubular contacts 50 of the terminals 24. The inlets 60 have a smaller diameter than the tubular contacts 50 so that the face plate of the cap member 22 retains the terminals 24 in the terminal cavities 30 in the forward direction. The two opposite side walls 62 of the cap member 22 close the channels 42 and hold the tubular contacts 50 in their interference positions. Thus, the terminals 24 are accurately located and securely retained in the terminal cavities 30 of the connector body 16 in all directions by solid plastic parts.

The ends of the side walls 62 also trap the flexible lips 54 in the axial direction which positively fastens the elastomeric ring 20 on the connector body 16. As illustrated in the drawing, the elastomeric ring 20 facilitates connector sealing as the elastomeric ring 20 easily provides a sealing means for the interface between the electrical connector 14 and the electrical socket connector 10. The elastomeric ring 20 is simply molded with a number of flexible radially outward lips 64.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector comprising:

a connector body having a terminal cavity extending axially through the connector body from a forward contact end to a rearward conductor end, said connector body having a nose portion at the forward contact end which comprises a plurality of ribs defining a channel at the forward portion of the terminal cavity, said connector body further having a lock shoulder in the terminal cavity which faces the forward contact end of the connector body, an elastomeric ring mounted on the connector body so that a portion of the elastomeric ring extends across the channel at the forward portion of the terminal cavity for biasing a portion of a terminal inserted into the terminal cavity to an interference position with respect to the lock shoulder so as to retain the terminal in the rearward direction, and a cap member mounted on the nose portion of the connector body to retain the terminal in the terminal cavity in the forward direction.

2. An electrical connector comprising:

a connector body having a terminal cavity extending axially through the connector body from a forward contact end to a rearward conductor end, said connector body having a medial portion and a nose portion of reduced height at the forward contact end which comprises a plurality of ribs defining a channel at the forward portion of the terminal cavity, said connector body further having a lock shoulder in the terminal cavity which faces the forward contact end of the connector body, an elastomeric ring mounted on the medial portion of the connector body, said elastomeric ring having a depending flexible lip engaging the ribs and extending across the channel at the forward portion of the terminal cavity for biasing a portion of a terminal inserted into the terminal cavity to an interference position in the channel where the lock shoulder retains the terminal in the terminal cavity in the rearward direction, and a cap member mounted on the nose portion of the connector body to retain the terminal in each terminal cavity in the forward direction and hold the terminal in its interference position in the channel.

3. The electrical connector as defined in claim 2 wherein the elastomeric ring has a number of flexible lips which extend radial outward to provide a sealing ring.

4. The electrical connector as defined in claim 2 wherein the connector body has a plurality of terminal cavities.

5. The electrical connector as defined in claim 2 wherein the connector body has two rows of terminal cavities and the elastomeric ring has a second depending flexible lip diametrically opposite the depending flexible lip.

6. An electrical connector comprising:

a connector body having a terminal cavity extending axially through the connector body from a forward contact end to a rearward conductor end, said connector body having a medial portion and a nose portion of reduced height at the forward contact end which comprises a plurality of ribs defining a channel at the forward portion of each terminal cavity, said connector body further having a lock shoulder in the terminal cavity which faces the forward contact end of the connector body, an elastomeric ring mounted on the medial portion of the connector body, said elastomeric ring having a depending flexible lip engaging the ribs and extending across the channel at the forward portion of the terminal cavity for biasing a terminal inserted into the terminal cavity to an interference position in the channel where the lock shoulder retains the terminal in the terminal cavity in the rearward direction, and a cap member mounted on the nose portion of the connector body which retains the terminal in the terminal cavity in the forward direction, holds the terminal in its interference position in the channel and traps the depending flexible lip to fasten the elastomeric ring in the axial direction.

7. An electrical connector comprising:

a connector body having a terminal cavity of oval cross section extending axially through the connector body from a forward contact end to a rearward conductor end, said connector body having a medial portion and a nose portion of reduced height at the forward contact end which comprises a plurality of ribs defining a channel at the forward portion of the terminal cavity, said connector body having a wedge shaped protrusion in the terminal cavity which includes a lock shoulder which faces the forward contact end of the connector body, a terminal disposed in the terminal cavity, said terminal having a tubular contact which is disposed in said channel, said tubular contact being of circular outline and having a diameter which is greater than the height of the ribs, an elastomeric ring mounted on the medial portion of the connector body so that it is circumferentially stretched, said elastomeric ring having a depending flexible lip engaging the ribs and extending across the channel at the forward portion of the terminal cavity and biasing the tubular contact of the terminal drawn against the bottom of the channel into an interference position where the lock shoulder retains the terminal in the terminal cavity in the rearward direction, said depending flexible lip being sufficiently flexible so as to permit the tubular contact to ride over the wedge shaped protrusion and reach the interference position, and a cap member mounted on the nose portion of the connector body which retains the terminal in the terminal cavity in the forward direction, holds the tubular contact in its interference position, in the channel, and traps the depending flexible lip to fasten the elastomeric ring in the axial direction.

8. The electrical connector as defined in claim 7 wherein the elastomeric ring has a number of flexible lips which extend radial outward to provide a sealing ring.

9. The electrical connector as defined in claim 7 wherein the connector body has a plurality of terminal cavities.

10. The electrical connector as defined in claim 7 wherein the connector body has two rows of terminal cavities and the elastomeric ring has a second depending flexible lip diametrically opposite the depending flexible lip.

* * * * *